US006168054B1

(12) United States Patent
Shelton, Jr.

(10) Patent No.: US 6,168,054 B1
(45) Date of Patent: Jan. 2, 2001

(54) OIL RECOVERY SYSTEM AND APPARATUS

(76) Inventor: William D. Shelton, Jr., P.O. Box 82, Crane, TX (US) 79731

( * ) Notice: Under 35 U.S.C. 154(b), the term of this patent shall be extended for 0 days.

(21) Appl. No.: 09/200,490

(22) Filed: Nov. 25, 1998

(51) Int. Cl.[7] ..... E21B 33/08

(52) U.S. Cl. ..... 222/608; 166/379; 417/234

(58) Field of Search ..... 222/608, 626, 222/627, 628, 108; 166/311, 162, 379, 81; 417/234

(56) References Cited

U.S. PATENT DOCUMENTS

| | | | |
|---|---|---|---|
| 1,415,047 | 5/1922 | Parsons . | |
| 1,765,085 | 6/1930 | Markey . | |
| 1,772,938 | 8/1930 | Hatfield . | |
| 1,920,443 | 2/1933 | Milburn . | |
| 2,698,055 | 12/1954 | Williams . | |
| 3,795,108 | 3/1974 | Schwandt . | |
| 4,070,135 | 1/1978 | Eller . | |
| 4,115,037 | 9/1978 | Butler . | |
| 4,738,104 | 4/1988 | Hahmann . | |
| 5,121,796 | 6/1992 | Wigington . | |
| 5,419,400 * | 5/1995 | Wigington, Sr. | 166/379 |
| 5,908,040 * | 6/1999 | Defraites, Jr. | 134/10 |

* cited by examiner

*Primary Examiner*—Steven O. Douglas
(74) *Attorney, Agent, or Firm*—Robert C. Peterson

(57) ABSTRACT

A self-contained oil recovery system is mounted on a portable trailer. The oil recovery system includes an oil recovery tank, an air driven motor for transferring oil from a source to the oil recovery tank after the initial blow down of the oil source into the oil recovery tank, and a hydraulic driven discharge pump for transferring oil from the oil recovery tank to a well site facility. The oil recovery system is capable of transferring oil from the oil source into the oil recovery tank and at the same time transferring oil out of the oil recovery tank to the well site facility, inasmuch as the oil recovery tank is at atmospheric pressure. The air driven is operated by an air motor supplied with air from an air pressure tank maintained under pressure by an air compressure. The air compressor and the hydraulically driven discharge pump are operated by hydraulic motors. The hydraulic motors are operated as part of a hydraulic system including a hydraulic fluid reservoir and hydraulic controls and pumps. The hydraulic pump is driven by a self-contained motive power unit such as a diesel engine. In addition, the portable trailer is provided with hydraulic jacks for stabilizing the trailer mounted self-contained oil recovery system.

10 Claims, 2 Drawing Sheets

OIL RECOVERY SYSTEM AND APPARATUS

BACKGROUND OF THE INVENTION

The present invention relates to an oil recovery system and apparatus and more particulary to a portable oil recovery trailer mounted oil recovery system and apparatus primarily for recovering oil otherwise lost during work over operations in an environmentally safe operation.

In the past copious quantities of oil were spilled that not only contaminated the surrounding surface of the oil well but wasted oil quantities. In this time of environmental awareness oil spills upon the ground are not only damaging to the soil, ground water, rivers and streams due to run off in rain storms, but also waste valuable oil which is thought to be a finite resource retained in the earth below its surface. Furthermore, crude oil often contains chemicals that are equally or more dangerous to the environment that the oil itself. Some suggestions for containing oil spills during work over operations or otherwise include vacuum tanks or suction tanks acting somewhat like a giant vacuum cleaner. Others have proposed various equipment (such as open basins surrounding the casing) useful in recovering oil spills.

SUMMARY OF THE INVENTION

The present invention provides a compact portable recovery trailer which is transferred to the well site and connected to the "Christmas Tree" of an oil well prior to commencement of work over operations. The system and apparatus provided aboard the portable oil recovery trailer permit recovery of oil during the blow down operation into the recovery tank and thereafter during the pulling of the tube string by providing a suction pump for recovery of oil from the oil well into the same recovery tank used for recovery of oil during blow down of the oil preliminary to the work over operation.

The system and apparatus are provided on a self-contained trailer which is placed at the oil well site and includes an oil recover tank, hydraulic motors and pumps, diesel engine, air compresor, high pressure air tanks or cylinders to provide air pressure required for an air driven pump with an air regulator, and associated piping or flow lines wherein the oil recovered during blow down of the well goes directly to the oil recovery tank maintained at atmospheric pressure and thereafter, the oil is pumped by an air driven pump or any other suitable pump into the oil recovery tank during removal of the tubing string. The trailer platform maybe stabilized by hydraulic jacks appropriately located on the trailer. The system and apparatus are designed to deliver the oil recovered to the tank battery or tank truck or whatever receptacle is desirable.

The present apparatus and system provide a self-contained protable trailer including a diesel engine with diesel fuel storage to operate the hydraulic pumps with on board hydraulic oil storage which supply hydraulic fluid to operate hydraulic jacks and hydraulic motors associated with recovery of oil during work over operations for driving the hydraulic motor to operate an air compressor for maintaining the air tanks with sufficient air pressure to drive an air pump. The apparatus and system are designed such as to permit continuous oil recovery while discharging oil into tank batteries or tank trucks as it is being recovered at the well site. The apparatus and system, which is coupled directly to the "Christmas Tree", provide an environmently safe and simple process for recovery of oil during blown down of the well as well as during removal of the tubing string and is capable of both pumping oil into the oil recovery tank and out to tank batteries or other transport equipment simultaneously.

The system and apparatus are provided on a portable trailer or sled which is placed at the oil well site and includes an oil recover tank, hydraulic motors and pumps, a motive power unit, and associated piping or flow lines wherein the oil recovered during blow down of the well goes directly to the oil recovery tank maintained at atmospheric presure and thereafter, the oil is pumped during removal of the tubing string into the oil recovery tank. The system and apparatus are designed to deliver the oil recovered to the tank battery or tank truck or whatever receptacle is desirable.

The present apparatus and system provide a self-contained portable trailer including a motive power unit to operate the hydraulic pumps with on board hydraulic oil storage which supply hydraulic fluid to operate hydraulic jacks and hydraulic motors associated with recovery of oil during work over operations for driving the hydraulic motor to operate an air compressor for maintaining the air tanks with sufficient air pressure to drive an air pump. The apparatus and system are designed such as to permit continuous oil recovery while discharging oil into tank batteries or tank trucks as it is being recovered at the well site. The apparatus and system, which is coupled directly to the "Christmas Tree", or other source of oil, provide an enviroment safe and simple process for recovery of oil during blown down of the well as well as during removal of the tubing string and is capable of both pumping oil into the oil recovery tank and out to tank batteries or other transport equipment simultaneously.

DESCRIPTION OF PREFERRED EMBODIMENT

Figure 1:
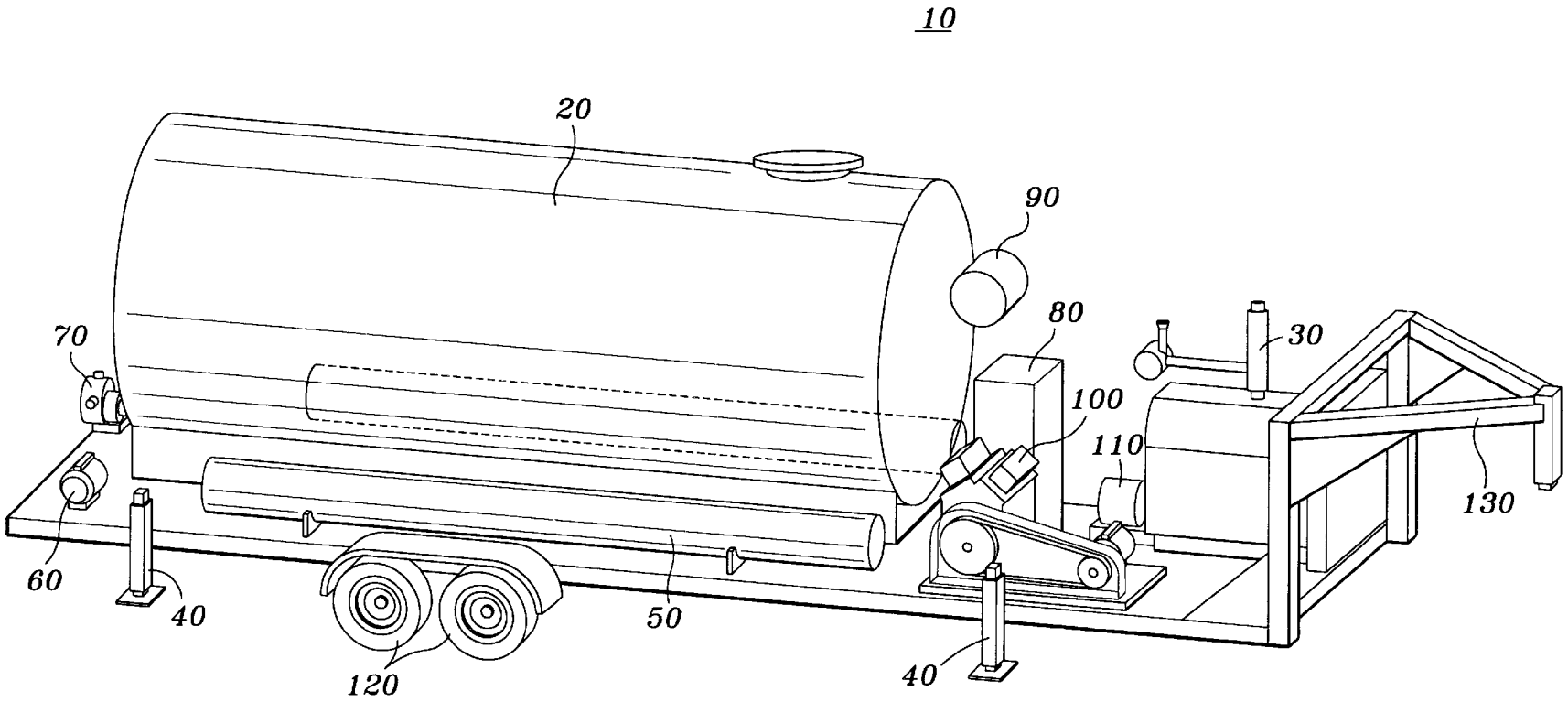
FIG. 1 is a prospective view of the self-contained oil recovery trailer and the aboard apparatus.
Figure 2:
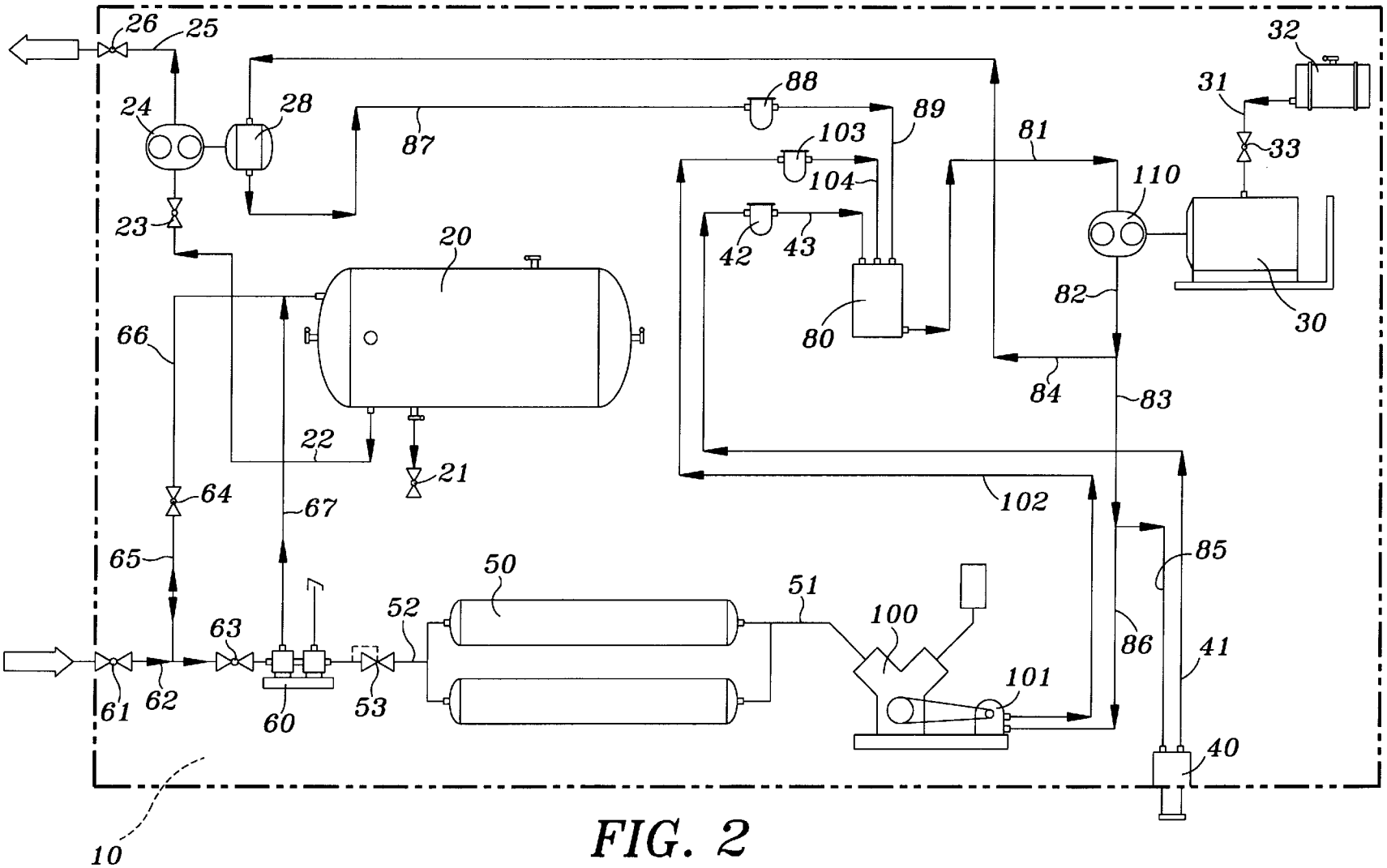
FIG. 2 is a schematic diagram illustrating the functional arrangement of the apparatus aboard the self-contained oil recovery trailer.

Referring now to FIGS. 1 and 2, the self-contained oil recovery trailer 10 includes an oil recovery storage tank 20, a diesel engine 30, trailer hydraulic jacks 40, air cylinders 50, air driven pump 60, hydraulic driven pump 70, hydraulic oil storage tank 80, diesel fuel storage tank 90, air compressor 100, hydraulic pump 110, wheels 120 and trailer hitch arrangement 130. A flexible hose and coupling (not shown) is attached between the "Christmas Tree" (not shown) on the oil well and inlet valve 61 on the self-contained oil recovery trailer 10. Inlet valve 61 is coupled through flow line 62 to inlet valve 63 of air driven pump. Flow line 62 includes a "T" connection to valve 64 through flow line 65 and flow line 66 into storage tank 20. Air driven pump 60 is connected by flow line 67 to a "T" in flow line 66 and thus into storage tank 20. Storage tank 20 has a drain valve 21 and discharge line 22 to a valve 23 which is coupled to the suction side of hydraulic driven pump 24 and the discharge side is connected to flow line 25 with outlet valve 26 which is coupled by a flexible hose (not shown) to a tank battery or tank truck.

Diesel engine 30 is connected with flow line 31 to diesel fuel storage 32, a valve 33 is used to control the fuel transferred to the diesel engine. Diesel engine 30 drives twin stacked hydraulic pumps 110. Hydraulic oil storage tank 80 is connected by flow line 81 to the inlet of hydraulic pump 110 flow line 82 is connected to the oulet side of hydraulic pump 110 and branches into flow line 83 and flow line 84. Flow line 83 branches into flow lines 85 and hydraulic jacks 40 and flow lines 86 into hydraulic motor 101. The return hydraulic fluid flow from jack 40 travels through flow line 41, filter 42 and flow line 43 back to hydraulic reservoir or storage tank 80. The return flow from hydraulic motor 101 returns through line 102 through filter 103 and line 104 to hydraulic storage tank 80. Flow line 84 is connected to the inlet side of hydraulic motor 28 and the return flow from hydraulic motor 28 is through flow line 85, 87 and filter 88 and flow line 89.

Air compressor 100 is connected to high pressure air tanks 50 through flow line 51. High pressure air tanks 50 are connected through flow line 52 to pressure regulator 53 to drive air motor 55 of air driven pump 60.

In operation the trailer 10 is brought to the well site of a well to undergo work over and is placed in a convenient location to the well (not shown). Once the approciate location is determined the diesel engine 30 is started and hydraulic pump 110 furnishes hydraulic fluid from hydraulic oil storage tank 80 through flow lines 82, 83 and 85 to activate hydraulic jacks 40 to raise the trailer such that the tractor or vehicle (not shown) that pulls the trailer can be separated from the trailer and can return to its station or for other use. Once the trailer 10 has been unhitched from the tractor or vehicle hauling it, hydraulic jacks 40 are adjusted to stablize the trailer 10. After the trailer 10 is stabilized by hydraulic jacks 40 a flexible hose is secured to the "Christmas Tree" at one end and valve 61 at the other end to permit flow of fluid from the well to the trailer 10. The hydraylic controls (not shown) direct hydraulic fluid from hydraulic oil storage tank 80 through hydraulic pump 110 through flow lines 82, 83 and 86 to hydraulic motor 101 to operate air compressor 100 and furnish compressed air through flow line 51 into air tanks 50. Air tanks 50 supply high pressure air through flow line 52 through pressure regulator 53 to air driven pump 60.

Initially valve 61 is opened and valve 63 is closed and valve 64 is opened to permit flow down of the well through flow lines 62, 65 and 66 into the oil recovery tank 20. After the initial blow down of the well, valve 64 is closed and valve 63 is opened and air driven pump 60 is started and fluid from the well is introduced to the suction side of air driven pump 60 where it is pumped into oil recovery tank 20 through flow lines 66 and 67.

A second flexible hose (not shown) is coupled from the outlet valve 26 on the trailer 10 to a tank battery or an oil transport vehicle (not shown). Once the fluid level in recovery tank 20 reaches a desired level to transfer fluid to the storage battery the hydraulic controls are activated such that hydraulic fluid from hydraulic oil storage tank 80 is transferred through flow line 82 to hydraulic pump 110 through flow line 82 and 84 to operate hydraulic motor 28 which in turn operated hydraulic driven pump 24. Valve 23 in discharge line 22 is opened to permit fluid from recovery tank 20 to be pumped by hydraulic pump 24 through flow line 25 and 26 which is also opened to the tank battery. It should be understood that the operation of removing oil from the oil recovery tank 20 may be done while fluid from the well is pumped by air driven pump 60 into the oil recovery tank 20. Oil recovery tank 20 remains at atmospheric pressure at all times.

Once the work over operation is completed and the self-contained oil recovery trailer 10 goes through a shut down procedure which includes emptying of recovery tank 20 into the tank battery or transport vehicle at which valve 26 is closed and the flexible coupling is removed and the hydraulic controls are manipulated to shut down hydraulic motor 28. Also, inlet valve 61 is closed and flexible hose is uncoupled from inlet valve 61 and from the "Christmas Tree". The flexible hoses connected to both inlet valve 61 and the oulet valve 26, which may be furnished by either the well service company doing the work over or stored on the trailer as desired, are then stored for reuse by the well service company or stored on the self-contained recovery trailor. Before the inlet valve 61 is closed the air driven pump 60 is shut down by manipulating the hydraulic controls to shut down hydraulic motor 101. After the trailer has been uncoupled from the "Christmas Tree" and the tank battery, hydraulic jacks are activated to raise the trailer to permit the tracter to attach to the hitch arrangement 120 for transfer to the next location.

What is claimed is:

1. A trailer mounted, self-contained oil recovery system for coupling to an oil well during work over operations comprising:

(a) an oil recovery tank;

(b) an air compressor;

(c) high presure air tanks;

(d) a hydraulic system including a reservoir, a pair of hydraulic pumps and two hydraulic driven motors;

(e) a motive power unit for operating the hydraulic pumps;

(f) an air driven pump operated by the air compressor;

(g) an inlet valve for coupling the source of oil to be recovered to the oil recovery system and an outlet valve for coupling the oil recovery system to well site storage;

(h) valve means for by-passing the air driven pump blow down of the oil well to transfer the oil into the oil recovery tank and thereafter to the air driven pump for transfer of the oil from the well site into the recovery tank when activated;

(i) a discharge pump for transferring oil from the oil recovery tank when activated;

(j) hydraulic control means to activate the hydraulic motors to operate the discharge pump and the air compressor.

2. The self-contained oil recovery system of claim 1 wherein the self-contained oil recovery trailer has stabilizing hydraulic jacks operated by the hydraulic system.

3. The self-contained oil recovery system of claim 2 wherein the air compressor includes air storage means for maintaining air pressure sufficient to drive the air driven pump.

4. The self-contained oil recovery system of claim 2 wherein the self-contained oil recovery trailer has stabilizing hydraulic jacks operated by the hydraulic system.

5. The self-contained oil recovery system of claim 2 wherein the motive power unit is a diesel engine with a fuel supply.

6. The self-contained oil recovery system of claim 1 wherein the motive power unit is a diesel engine and fuel supply.

7. A trailer mounted, self-contained oil recovery system for receiving oil from a well site comprising:

(a) an oil recovery tank for receiving recovered oil;

(b) an air driven pump;

(c) an air compressor for operating the air driven pump;

(d) a discharge pump driven by a hydraulic motor;

(e) a first series of flow lines for directing oil from an inlet valve directly to the oil recovery tank during blow down of an oil well, and thereafter, to the air driven pump for further transfer into the oil recovery tank;

(f) a second series of flow lines for transferring oil from the oil recovery tank to a discharge pump for transfer through an outlet valve to onsite storage;

(g) a hydraulic system for operating the discharge pump and operating the air compressor, the hydraulic system including at least one hydraulic pump and a hydraulic fluid reservoir for supplying hydraulic fluid to the hydraulic pump;

(h) a motive unit for operating the hydraulic pump.

8. A self-contained oil recovery apparatus mounted on a portable platform comprising:

(a) an oil recovering tank;

(b) a hydraulic pump;

(c) a hydraulic driven pump;

(d) an air driven suction pump;

(e) an inlet valve;

(f) an outlet valve;

(g) a motive power unit for operating the hydraulic pump;

(h) an air compressor for operating the air driven suction pump;

(i) a first hydraulic motor driven by the hydraulic pump for operating the hydraulic driven pump;

(j) a second hydraulic motor driven by the hydraulic pump for operating the air compressor to provide air for operating the air driven suction pump;

(k) a hydraulic system, including hydraulic controls to operate the first and second hydraulic motors;

(l) a first series of flow lines interconnecting the inlet valve directly to the oil recovery tank and the air driven pump and from the air driven pump to the oil recovery tank;

(m) a second series of flow lines interconnecting the oil recovery tank to the first hydralic driven pump and from the hydraulic driven pump to the outlet valve.

9. The self-contained oil recovery apparatus of claim 8 wherein an air tank is provided for maintaining the pressure necessary to operate the air driven suction pump.

10. The self-contained oil recovery apparatus of claim 8 wherein the motive power unit is a diesel engine with a fuel supply.

* * * * *